US007004655B2

(12) United States Patent
Ferrara

(10) Patent No.: US 7,004,655 B2
(45) **Date of Patent: *Feb. 28, 2006**

(54) CUSHIONING ELEMENT

(76) Inventor: Daniel A. Ferrara, 221 Looking Glass Hill, Morris, CT (US) 06793-1026

( * ) Notice: Subject to any disclaimer, the term of this patent is extended or adjusted under 35 U.S.C. 154(b) by 0 days.

This patent is subject to a terminal disclaimer.

(21) Appl. No.: 10/673,468

(22) Filed: Sep. 30, 2003

(65) Prior Publication Data

US 2004/0136769 A1 Jul. 15, 2004

Related U.S. Application Data

(63) Continuation-in-part of application No. 09/793,590, filed on Feb. 27, 2001, now Pat. No. 6,648,535.

(51) Int. Cl.
*A46B 5/02* (2006.01)

(52) U.S. Cl. ..... 401/6; 16/421; 16/430

(58) Field of Classification Search ..... 401/6, 401/48, 52, 54, 195; 16/421, 422, 430, 436; 473/549, 551, 552; 15/443; 74/551.9; 81/489
See application file for complete search history.

(56) References Cited

U.S. PATENT DOCUMENTS

| | | | |
|---|---|---|---|
| 412,479 | A | 10/1889 | Davis |
| 782,388 | A | 2/1905 | Goldsmith |
| 839,537 | A | 12/1906 | Beaumel |
| 3,398,213 | A | 8/1968 | Chetakian |
| 3,407,406 | A | 10/1968 | Werner et al. |
| 3,518,786 | A | 7/1970 | Holtvoigt |
| 3,529,368 | A | 9/1970 | Canfield |
| 3,552,044 | A | 1/1971 | Wiele |
| 3,748,669 | A | 7/1973 | Warner |
| 3,748,779 | A | 7/1973 | Cherk et al. |
| 3,968,530 | A | 7/1976 | Dyson |
| 4,035,089 | A | 7/1977 | Schwartz et al. |
| 4,038,762 | A | 8/1977 | Swan, Jr. |
| 4,144,658 | A | 3/1979 | Swan, Jr. |
| 4,167,347 | A | 9/1979 | Hoyle |
| 4,229,546 | A | 10/1980 | Swan, Jr. |
| 4,243,754 | A | 1/1981 | Swan, Jr. |
| 4,252,910 | A | 2/1981 | Schaefer |
| 4,255,202 | A | 3/1981 | Swan, Jr. |
| 4,338,270 | A | 7/1982 | Uffindell |
| 4,467,053 | A | 8/1984 | Markle |
| 4,472,847 | A | 9/1984 | Gammons et al. |
| 4,588,229 | A | 5/1986 | Jay |

(Continued)

FOREIGN PATENT DOCUMENTS

DE 1 511 325 A 7/1969

(Continued)

*Primary Examiner*—David J. Walczak
*Assistant Examiner*—Peter deVore
(74) *Attorney, Agent, or Firm*—Sughrue Mion, PLLC

(57) ABSTRACT

The present invention relates to a cushioning element adapted to be mounted on an article to provide cushioning therefor. The cushioning clement of the present invention has a bladder body at least partially defining a filling chamber. The filling chamber is filled with a flowable particulate matter. The present invention further includes a mounting member adapted to mount the bladder body onto the article. According to the present invention, at least a portion of the bladder body is deformable and the particulate matter within the filling chamber is capable of flowing inside the filling chamber upon the application of a deforming force to the deformable portion of the bladder body.

20 Claims, 7 Drawing Sheets

U.S. PATENT DOCUMENTS 4,660,238 A 4/1987 Jay
4,709,431 A 12/1987 Shaktman
4,726,624 A 2/1988 Jay
4,728,551 A 3/1988 Jay
4,761,843 A 8/1988 Jay
4,765,856 A 8/1988 Doubt
4,842,330 A 6/1989 Jay
4,934,024 A 6/1990 Sexton, I
4,952,190 A 8/1990 Tarnoff et al.
4,952,439 A 8/1990 Hanson
4,953,913 A 9/1990 Graebe
5,000,599 A 3/1991 McCall et al.
5,015,313 A 5/1991 Drew et al.
5,058,291 A 10/1991 Hanson
5,079,786 A 1/1992 Rojas
5,079,787 A 1/1992 Pollmann
5,093,138 A 3/1992 Drew et al.
5,147,685 A 9/1992 Hanson
5,190,504 A 3/1993 Scatterday
5,201,780 A 4/1993 Dinsmoor, III et al.
5,204,154 A 4/1993 Drew et al.
5,322,718 A 6/1994 Low
5,335,907 A 8/1994 Spector
5,336,708 A 8/1994 Chen
5,350,342 A 9/1994 Scatterday
5,475,894 A 12/1995 Wildforster
5,508,334 A 4/1996 Chen
5,548,848 A 8/1996 Huybrechts
5,549,743 A 8/1996 Pearce
5,633,286 A 5/1997 Chen
5,716,303 A 2/1998 Scatterday
5,718,655 A 2/1998 Phillips
5,766,704 A 6/1998 Allen et al.
5,827,459 A 10/1998 Allen et al.
5,839,992 A 11/1998 Phillips
5,846,145 A 12/1998 Tinlin
5,882,280 A 3/1999 Dahlin, Jr.
5,891,000 A 4/1999 Phillips
5,906,887 A 5/1999 Withers
5,924,661 A 7/1999 Chernack
5,939,157 A 8/1999 Allent et al.
5,955,159 A 9/1999 Allen et al.
5,970,581 A 10/1999 Chadwick et al.
5,985,383 A 11/1999 Allent et al.
6,146,038 A 11/2000 Mittersinker et al.
6,379,065 B1 4/2002 Perry et al.
6,648,535 B1 * 11/2003 Ferrara, Jr. ..... 401/6

FOREIGN PATENT DOCUMENTS

DE 4 227 537 A1 2/1994

* cited by examiner

CUSHIONING ELEMENT

CROSS-REFERENCE TO RELATED APPLICATIONS

This application is a Continuation-in-Part of U.S. patent application Ser. No. 09/793,590 filed on Feb. 27, 2001, now U.S. Pat. No. 6,648,535, the entire disclosure of which is incorporated herein by reference.

FIELD OF THE INVENTION

The present invention relates generally to a cushioning element that is adapted to be mounted onto an article to provide cushioning therefor. More particularly, the cushioning element of the present invention contains a flowable particulate filling material. The present invention further relates to a cushioning article that includes such a cushioning element to provide cushioning such as for a comfortable grip and/or shock absorption.

BACKGROUND OF THE INVENTION

Grip and shock absorption elements are commonly used on various articles to provide a cushioning effect. More particularly, grip elements have been designed for placement on the gripping portion of hand-held articles to increase comfort during gripping of the hand-held article. Because grip and shock absorption elements are provided to address different problems or user needs, a variety of different grip and shock absorption elements with different properties are available.

For instance, for purposes of increased comfort to users who grip a handheld article very tightly, grip elements of soft foam have been provided to permit ready deformation of the grip element and resulting in enhanced comfort during gripping thereof. In recent years, grip elements filled with fluid or gel materials have become popular as well. However, due to the nature of such grip elements, they tend to rebound to their initial shapes once the compressing force is released. Therefore, when using hand-held articles with any of these deformable grip elements, the user has to hold the grip element continuously and tightly in order to retain the desired deformed shape, which is the user's comfortable grip configuration. The continuous and tight holding of the grip element can easily fatigue the user's hand and fingers.

U.S. Pat. No. 5,970,581 to Chadwick et al. discloses a customizable gripping device. The gripping device employs a controllable fluid that is capable of changing its state from fluid to solid upon the application of an appropriate energy field. When the controllable fluid is in its fluid state and thus is deformable, the user is free to imprint a customized grip in the gripping device. When the controllable fluid changes to its solid state thereafter, the customized grip is "frozen" and the user's grip is "memorized." As a result, the user need not keep gripping the article tightly to retain the customized grip. However, the Chadwick et al. patent involves an additional activating assembly for applying a field to the controllable fluid to change its Theological behavior.

It would be desirable to provide a grip element that not only can readily deform to provide a comfortable grip for the user but also can retain the desired deformed shape, which is the user's comfortable grip configuration, without the need of applying a continuous compressing force thereunto. It would also be desirable for such grip element to maintain the desired deformed shape without application of an energy field thereto.

SUMMARY OF THE INVENTION

The present invention relates to a cushioning element which is adapted to be mounted onto an article to provide cushioning therefor. The cushioning clement of the present invention comprises an encasing member at least partially defining a filling chamber filled with flowable particulate matter. The present invention further comprises a mounting member adapted to mount the encasing member onto an article to be gripped. According to the present invention, at least a portion of the encasing member is deformable and the particulate matter within the filling chamber is thereby capable of flowing inside the filling chamber upon the application of a deforming force on the deformable portion of the encasing member.

The particulate matter can be any non-fluid, and/or "non-gel material that is capable of freely flowing within the filling chamber upon the application of a compressing force on the deformable portion of the encasing member. The type and quantity of the particulate matter, as well as the size and shape of the individual particles thereof, can be determined according to the specific application of the cushioning element.

The deformable portion of the encasing member can be made of a material capable of deforming in response to a deforming force applied thereto. Preferably, the deformable portion is made of a pliable material so that it can yield to the deforming force along with the flowable particulate matter. As a result, the deformable portion may, along with the flowable particulate matter, provide a cushioning effect, such as a comfortable grip or shock absorption. The area, size, and thickness of the deformable portion can be determined according to the specific application of the cushioning element.

The cushioning element of the present invention is intended to be used (among other things) with an article to provide a cushioning effect upon gripping the cushioning element on the article, or to provide a cushioning effect upon contact with another article, or to provide a cushioning effect upon contact with a part of a human body. One application of the cushioning element is to provide a comfortable grip for hand-held articles, such as writing instruments, razors, toothbrushes, utensils, and tools. The cushioning element can also provide a comfortable cushioning for such articles as splints or seatings. In addition, the cushioning element can provide shock absorption for articles which transmit impact to the user, such as impact tools (e.g., hammers), various sports equipments (e.g., helmets, knee pads, and rackets), and motor-driven devices (e.g., power drills or motorcycles). For each application, the cushioning element is constructed accordingly to fit onto a given article to provide an appropriate cushioning effect during use of the article.

These and other features and advantages of the present invention will be readily apparent from the following detailed description of the invention, the scope of the invention being set out in the appended claims.

The above and other features of the invention including various and novel details of construction and process steps will now be more particularly described with reference to the accompanying drawings and pointed out in the claims. It will be understood that the particular optical fiber cable embodying the invention is shown by way of illustration only and not as a limitation of the invention. The principles and features of this invention may be employed in varied and numerous embodiment without departing from the scope of the invention.

The above and other features of the invention including various and novel details of construction and process steps will now be more particularly described with reference to the accompanying drawings and pointed out in the claims. It will be understood that the particular cushioning element embodying the invention is shown by way of illustration only and not as a limitation of the invention. The principles and features of this invention may be employed in varied and numerous embodiment without departing from the scope of the invention.

BRIEF DESCRIPTION OF THE DRAWINGS

The detailed description of the present invention will be better understood in conjunction with the accompanying drawings, wherein like reference characters represent like elements, as follows.

DETAILED DESCRIPTION OF THE INVENTION

Figure 1:
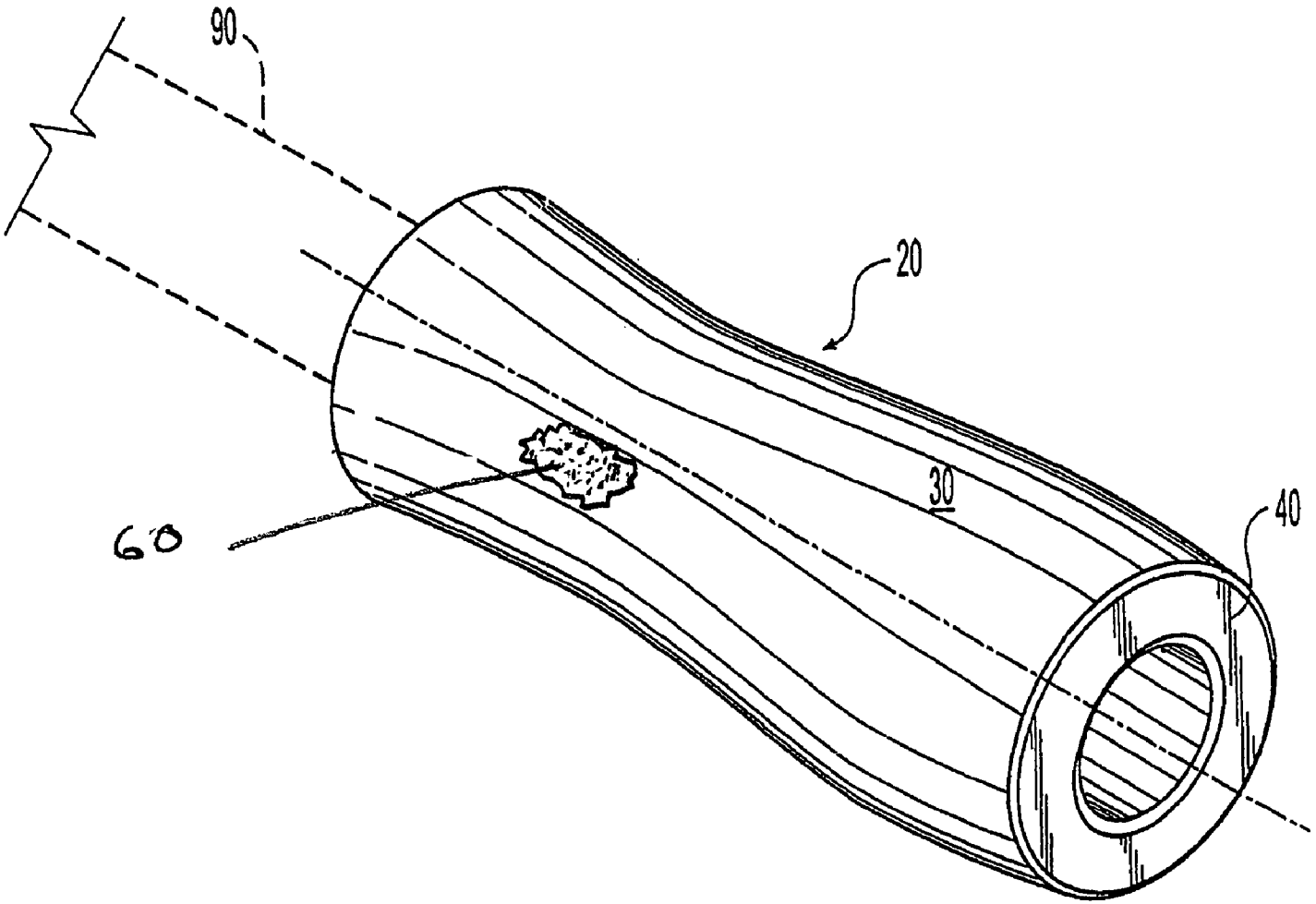
FIG. 1 is a perspective view of a cushioning element adapted for mounting on a hand-held article in accordance with the principles of the present invention.
Figure 2:
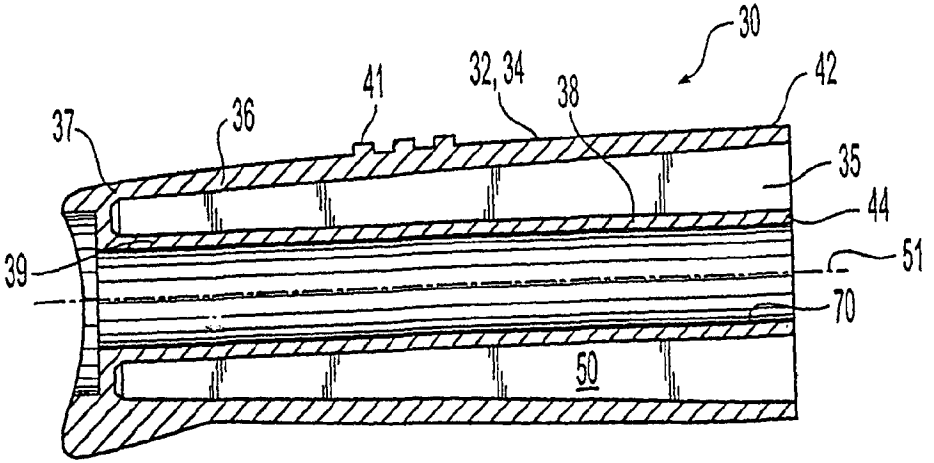
FIG. 2 is a longitudinal cross-sectional view of the encasing member of FIG. 1.

Exemplary cushioning elements embodying the principles of the present invention are shown throughout the drawings. In the following description of various embodiments of cushioning elements, similar elements or components thereof are designated with reference numbers that have the same last two digits and redundant description is omitted.

The cushioning elements of the present invention utilize flowable particulate matter to provide a cushioning effect upon application of a deforming force thereto. The particulate matter is capable of flowing within a filling chamber after being subjected to a deforming force. Additionally or alternatively, the particulate matter is capable of retaining the deformed shape even after the deforming force has been released.

The encasing member includes a deformable portion. Deformation of the deformable portion transmits the deforming force to the particulate matter and causes the same to flow and to conform to the-desired configuration determined by the deforming force. Because the cushioning elements of the present invention are constructed to provide a cushioning effect, such as a comfortable grip and/or shock absorption, to an article, the cushioning elements are adapted to be mounted onto the article. Accordingly, the cushioning elements of the present invention typically include a mounting member that is formed to mount the cushioning element on an article.

FIGS. 1 to 4 illustrate an exemplary cushioning element 20 formed according to a first embodiment of the present invention. Exemplary cushioning element 20 comprises an encasing member 30 which at least partially defines a filling chamber 50 filled with flowable particulate matter 60. At least a portion 32 of encasing member 30 is deformable in response to the application of a deforming force thereto. Thus, deformation of deformable portion 32 typically causes particulate matter 60 to flow inside filling chamber 50 to conform to the deforming force. Consequently, cushioning element 20 assumes a deformed configuration in response to a deforming force applied thereto and thereby provides a comfortable grip. In addition, the deformation of flowable particulate matter 60 and deformable portion 32 can also provide a shock absorption effect.

Deformable portion 32 of encasing member 30 can be made of any pliable material that is capable of deforming and yielding to a deforming force applied thereto. According to the present invention, when a deforming force is applied to deformable portion 32 and, in turn, particulate matter 60, deformable portion 32 deforms accordingly to yield to the deforming force. At the same time, particulate matter 60 encased in filling chamber 50 is forced to flow within filling chamber 50 to conform to the deformed configuration of deformable portion 32 and to yield to the deforming force. It will be appreciated that deformable portion 32 is sufficiently sized to receive a deforming force as well as to allow particulate matter 60 to flow inside filling chamber 50. For example, deformable portion 32 may be a flexible wall member 34 that forms at least -a part of encasing member 30. It will be appreciated that the larger deformable portion 32 is, the more accessible particulate matter 60 is for deformation. If desired, all of encasing member 30 may be deformable. For the sake of simplicity, reference is made to a deformable portion 32 of encasing member 30, such portion 32 optionally being either a portion of or the entirety of encasing member 30.

Particulate matter 60 can be formed of any non-fluid, and/or non-gel material and may be filled and sealed in filling chamber 50. If desired, particulate matter 60 may be selected to be non-toxic. After being subjected to a deforming force, the individual particles of particulate matter 60 are capable of freely flowing within filling chamber 50 and away from the deforming force. Consequently, the encased particulate matter 60 as well as deformable portion 32 can be displaced and therefore can assume a deformed configuration in response to the deforming force and hence provide a cushioning effect.

Additionally or alternatively, particulate matter 60 can be formed so that it is capable of remaining displaced and retaining the deformed shape even after the deforming force has been released. For instance, particulate matter 60 can be made of a material that has limited tendency to resume its initial shape after being subjected to deformation. More typically, the nature of particulate matter 60 and/or the manner in which it is filled in filling chamber 50 permits particulate matter 60 to be displaced by a deforming force without returning to its original location or configuration once the deforming force is removed. As a result, once a deformed configuration is shaped based on a user's comfortable grip, the user need not continuously and tightly hold cushioning element 20 to retain the comfortable grip. It will be appreciated that other arrangements, such as the quantity of particulate matter 60 within filling chamber 50 and/or properties of deformable portion 32 as discussed in greater detail below, may also achieve the same or similar results and therefore are within the scope of the present invention.

If desired, particulate matter 60 can be made or formed so that it not only can flow within filling chamber 50 into a deformed configuration but also can provide a desired cushioning effect in response to a deforming force applied thereto. For instance, particulate matter 60 can be capable of flowing within filling chamber 50 and at the same time providing a desired resistance to the deforming force. Accordingly, particulate matter 60 can provide a comfortable grip to the user. It will be appreciated that other alterations to particulate matter 60, such as changes to its shape and size, can also achieve the same or similar results and therefore are within the scope of the present invention.

The individual particles of particulate matter 60 may be made from a solid or incompressible material. Exemplary materials for particulate matter 60 include, but are not limited to, thermoplastics (e.g., phenolics, epoxies, acrylics, polyesters, and the like), thermoset plastics (e.g., phenolics, epoxies, acrylics, polyesters, and the like), synthetic and natural rubber (e.g., cured to a high hardness), ceramics, silicon, quartz, mineral, carbon, glass, metals, microbeads, phenol, wood, silica, sand, salt, seeds, grain (e.g., flour or corn starch), organic materials (e.g., cherry pits), or other microspheres, granules, or crystallized or powder particles. If desired, the particles may be selected to not absorb water. Because such individual particles of particulate matter 60 may be undeformable after being subjected to a deforming force, they are readily flowable in response to repeated deforming forces. Thereby, cushioning element 20 is capable of continued use after initial deformation.

If desired, the individual particles of particulate matter 60 may be formed of a resilient material which is capable of deforming when subjected to a deforming force yet which is capable of resuming its initial shape upon release of the deforming force. In this embodiment, individual particles in particulate matter 60 may undergo at least partial deformation after being subjected to a deforming force. Nevertheless, such particulate matter 60 is still capable of flowing within filling chamber 50 in response to a deforming force. Once the deforming force is released, the deformed individual particles are capable of resuming their initial shapes and are ready to move relative to one another when another deforming force is applied thereto. Preferably, the individual particles of particulate matter 60 may be formed from a material that would not be permanently deformed or crushed after being subjected to deformation. This characteristic is advantageous because such particulate matter 60 can be subjected to repeated deforming forces yet the individual particles thereof preferably should still be capable of moving relative to one another to provide a cushioning effect.

Additionally or alternatively, particulate matter 60 can be made of a material that is capable of providing a variable cushioning effect. For instance, individual particles of particulate matter 60 can be at least partially formed by a metallic material. Such metallic particles in particulate matter 60 can be magnetized as desired, such as by applying a magnetic field thereto, to alter the behavior of the metallic particles. Consequently, the cushioning effect can be adjusted. In addition. metallic particulate matter 60 or another type of heavier flowable material may also add weight to cushioning element 20, which may be particularly desirable for certain applications, such as to impact tools.

Additional or alternative properties and characteristics of individual particles of particulate matter 60 can be determined pursuant to specific applications of the cushioning element. For instance, when the cushioning elements are used mainly to provide a comfortable cushioning effect, particulate matter 60 can be formed of a material that is capable of providing a comfortable grip. Alternatively, when the cushioning elements are applied to impact articles which transmit forces to the user, particulate matter 60 can be formed of a material that is capable of providing shock absorption. Such impact articles can include, but are not limited to, handles of impact tools (e.g., hammers), handles of motor-driven devices (e.g., power drills or motorcycles), and various sports equipments (e.g., tennis rackets, golf clubs, or body protecting pads).

The shape of the individual particles of particulate matter 60 also may be selected based on the desired application of the cushioning element. Individual particles of particulate matter 60 may be formed in any desired shape, such as spherical, oval, or irregular shapes. For instance, particulate matter 60 can be formed from microspheres that may either be solid or have a hollow interior, such as to reduce the overall weight thereof. It will be appreciated that particulate matter 60 having individual particles of different shapes can be simultaneously used in cushioning element 20.

Optionally, particulate matter 60 can be formed from microspheres that may have an interior chamber filled with a gel or a liquid, such as to provide a comfortable temperature for a user or modified cushioning properties. If desired, particulate matter 60 can be formed of a material that is capable of assuming a comfortable temperature range for the user. For instance, particulate matter 60 can be made of a material that has low coefficient of heat transfer and low thermal mass. Unlike liquid or gel materials, such particulate matter 60 is capable of quickly conforming to the body temperature of he user so that cushioning element 20 does not feel cold or warm to the user. Additionally or alternatively, the air among the individual particles of particulate matter 60 may contribute to insulation. Accordingly, cushioning element 20 using comfortable temperature particulate matter 60 can function as an insulator against cold or warm temperatures and further enhance comfort.

In addition, the size of the particles forming particulate matter 60 may vary 35 depending on the specific application of cushioning element 20. Generally, the individual particles of particulate matter 60 can have any dimension so long as they may freely flow inside filling chamber 50 upon the application of a deforming force thereto and, at the same time, provide a sufficient cushioning effect. It is also desirable that the particles may have such a dimension that a sufficient number of particles may fit within filling chamber 50 and so that the particles can provide a comfortable feel when the user grips cushioning element 20. For instance, the average diameter of particulate matter 60 can be as low as, for example, approximately 1 gm. In a typical embodiment, however, in which the individual particles of particulate matter 60 are discernible, the minimum average diameter may be approximately 250 gm. However, in larger applications of cushioning element 20, the average diameter of each particle may be as large as 8 cm. A series of exemplary embodiments show that the following particle size ranges of particulate matter 60 can be effective for the cushioning purposes: 1 $\mu$m to 5 mm, 10 $\mu$m to 1 mm, 50 $\mu$m to 500 $\mu$m, and 100 $\mu$m to 400 $\mu$m respectively. It will be appreciated that one or more particle sizes of particulate matter 60 can be simultaneously used in cushioning element 20.

It will be appreciated that various aspects of particulate matter 60, among other factors as will be discussed hereinafter, may determine the cushioning effect of cushioning element 20. For instance, the quantity of particulate matter 60 filled in filling chamber 50 may affect the cushioning effect of cushioning element 20. When particulate matter 60 partially fills filling chamber 50, vacant space or air pockets (not shown) may exist in filling chamber 60. When being subjected to a deforming force, particulate matter 60 within filling chamber 50 is more likely to flow into the vacant space or air pockets, rather than flowing into a desired deformed configuration. Consequently, such vacant space or air pockets may alter the deformation and hence cushioning effect of the encased particulate matter 60. It is preferable that particulate matter 60 substantially fills the entire filling chamber 50 so the desired cushioning effect is imparted by particulate matter 60 and 25 not also by air pockets.

In an alternate embodiment, particulate matter 60 may even overfill filling chamber so that deformable portion 32 of encasing member 30 is stretched or expanded. Prestressing of deformable portion 32 may be advantageous in retaining the desired displacement of particulate matter 60, and thereby the deformed shape of cushioning 30 element 20 resulting from a deforming force, as will be discussed in greater detail below. Nevertheless, it will be appreciated that particulate matter 60 preferably is not filled in filling chamber 50 to the extent that particulate matter 60 cannot freely flow within filling chamber 50 in response to a deforming force. Furthermore, even though vacant space or air pockets are not desired, a certain amount of air can facilitate the flow of particulate matter 60 within filling chamber 50, since particles in a vacuum packed container do not readily flow.

The relative movement between the individual particles of particulate matter 60 may also affect the desired cushioning effect of cushioning element 20. It is desirable that the individual particles be capable of freely moving within encasing member 30. However, it is theorized that the friction generated between the individual particles of particulate matter 60 during their relative movement may resist the deforming force and, as a result, provide a firmer cushioning effect. Thus, particles of particulate matter 60 with a rougher surface finish may have a firmer cushioning effect because a larger amount of friction may be generated during relative movement between such particles if other characteristics remain the same. It will be appreciated that one or more types of particulate matter 60 can be simultaneously used in cushioning element 20.

The cushioning effect of cushioning element 20 may instead or in addition depend on the various characteristics of not only particulate matter 60, but also of encasing member 30 and, more particularly, deformable portion 32. Generally, but not necessarily, deformable portion 32 is made of a pliable material so that it can yield to a deforming force applied thereto. Exemplary materials which may be used to form deformable portion 32 may include, but are not limited to, synthetic or natural rubber, elastomers (including thermoplastic elastomers), resins (including thermoplastic resins), polyester, elastomer or plastic reinforced textiles (woven or non-woven), polyurethane, nylon, textiles of all sorts, leather, or the like. As deformable portion 32 yields to the deforming force, particulate matter 60 is forced to flow inside filling chamber 50. Consequently, both deformable portion 32 and particulate matter 60 deform and, at the same time, provide a cushioning effect. It is also preferred that deformable portion 32 is made of a material that is capable of repeated deforming in response to repeated application and removal of deforming forces. Thereby, cushioning element 20 may receive repeated deforming forces and still be able to provide a continuing cushioning effect.

In an alternate embodiment, deformable portion 32 may have a desired resilience so that it may closely conform to and retain the configuration of particulate matter 60. Such effect is more apparent when deformable portion 32 is at least somewhat stretched or pre-stressed. Exemplarily, but not exclusively, such pre-deformation may be formed by overfilling particulate matter 60 in filling chamber 50 as described above. As a result, deformable portion 32 is stretched beyond its initial shape and thus tends to compress particulate matter 60 into a given configuration resulting from deformations such as caused by gripping. Consequently, the stretched deformable portion 32 may contribute to the retention of the deformed configuration of particulate matter 60 even after the deforming force is released. Thereby, the user need not apply a constant deforming force on cushioning element 20 to retain the desired deformed shape of cushioning element 20.

The thickness, shape, and other characteristics of deformable portion 32 may be influenced by the specific application of cushioning element 20. It will be appreciated that the thickness of a deformable portion 32 used in cushioning element 20 for providing a comfortable grip can be smaller than the thickness of a deformable portion used in a cushioning element providing shock absorption, such as to withstand impact. Various characteristics of deformable portion 32 may vary along the length or circumference of cushioning element 20. Such characteristics may vary along a single deformable portion or a plurality of deformable portions, some or all of the deformable portions having differing characteristics. The shape and/or extent of deformable portion 32 can be determined by various factors, such as a typical grip of a user, so as to provide a sufficient cushioning effect and a comfortable grip to the user.

FIGS. 1 to 4 illustrate a first embodiment of cushioning element 20 configured to be mounted on an article 90 to provide a cushioning effect thereto. Accordingly, a mounting member 70 is provided on cushioning element 20 and adapted to mount cushioning element 20 on an article 90. Depending on the specific application of cushioning element 20, encasing member 30 as well as mounting member 70 may be formed in various manners to adapt cushioning element 20 for mounting on an article 90. Moreover, article 90 may be specifically adapted for receiving cushioning element 20. For example, a receiving recess may be formed in article 90 for receiving cushioning element 20 such that the exterior of cushioning element 20 does not extend beyond the exterior of the article. Alternatively, cushioning element 20 may be provided over a uniform-level exterior of an article such that cushioning element 20 extends beyond the exterior of the article. The discussion of mounting member 70 herein is carried out in connection with a specific embodiment of encasing member 30 configured for a specific application of cushioning element 20 of the present invention. However, it will be appreciated that various alternate embodiments of mounting member 70 are within the scope of the present invention.

The exemplary embodiment of cushioning element 20 shown in FIGS. 1 to 4 is configured to be mounted on hand-held articles 90, such as writing instruments, razors, toothbrushes, utensils (e.g., cooking or eating utensils), tools, rackets, sports equipment, and the like, to provide a comfortable grip therefor. Alternatively, cushioning element 20 may be mounted on various types of hand-held articles which transmit forces to the user, such as handles of impact tools (e.g., hammers), handles of motor-driven devices (e.g., power drills or motorcycles), and various sports equipments (e.g., tennis rackets, or golf clubs), to provide shock absorption therefor. In such applications, particulate matter 60 and deformable portion 32 of encasing member 30 can be selected to provide the desired comfortable grip or shock absorption as indicated above. Exemplarily, but not restrictively, the individual particles of particulate matter 60 can be larger to provide sufficient shock absorption for impact articles 90. Additionally or alternatively, encasing member 30 may be made of a stronger material to withstand the impact or vibrations associated with use of force-transmitting articles 90.

In the above applications, cushioning element 20 may be formed for insertion over an article 90. Accordingly, encasing member 30 of cushioning element 20 may be configured to mate with an article 90 to permit mounting of cushioning element 20 on article 90. In such an embodiment, mounting member 70 may be a portion of encasing member 30 configured to receive or to mate with an article 90 to mount cushioning element 20 on article 90. In the exemplary embodiment illustrated in FIGS. 1 to 5, encasing member 30 is formed with coaxial tubular outer and inner wall members 36 and 38 shaped for insertion over an elongated article. However, other configurations of encasing member 30 are within the scope of the present invention.

Outer and inner wall members 36 and 38 of the embodiment of FIGS. 1 to 5 are joined together to form an enclosed filling chamber 50 for containing particulate matter 60 therein. Optionally, outer and inner wall members 36 and 38 may be monolithic and coextensive (i.e., a single, unitary piece). An opening 35 is left in such embodiment to permit filling of particulate matter 60 therethrough. Opening 35 may be closed by either a closure element such as a plug 40 (described in further detail below) or by sealing wall members 36 and 38 together. In the latter embodiment, outer wall member 36 may extend continuously so that its end portions 37 and 42 merge with inner wall member 38 at its respective end portions 39 and 44. Thus, outer and inner wall members 36, 38 would, in effect, be coextensive and interchangeable. Upon insertion of cushioning element 20 over article 90, instead of sliding with respect to the article, inner wall member 38 may shift outwardly and outer wall member 36 may shift inwardly along a longitudinal axis, so that a monolithic wall member of encasing member 30 may be rolled over article 90 until positioned in the desired location. Alternatively, wall members 36 and 38 may be separately formed and then joined together, or otherwise formed, as discussed in greater detail below. It is nevertheless appreciated that encasing member 30 can be constructed and configured otherwise to adapt to other applications of cushioning element 20.

It will be appreciated that one of outer and inner wall members 36 and 38 may be specifically constructed to be contacted by the user. In an exemplary embodiment, outer wall member 36 is positioned for gripping at least a portion thereof. If desired, the entire outer wall member 36 may be made of a flexible material to provide maximum deformability and resulting cushioning effect to the user. As intended to be used as a gripping surface, outer wall member 36, including deformable portion 32, can desirably include additional features typical of a grip element. For instance, outer wall member 36 may be formed of a material that can provide the user with both a desirable tactile sensation as well as a useful function, such as anti-slipperiness or softness, during gripping. Exemplary materials that can provide such properties as anti-slipperiness or softness include, without limitation, natural or synthetic elastomers (such as urethane, silicone, polyamide, polyester, and the like), leather, thermoplastic elastomers, natural or synthetic rubber, impregnated woven or non-woven materials (the impregnant can be any elastomer or soft polymer), or soft thermoplastic polymers (such as polyurethanes, polyesters, polyamides, and the like).

Additionally or alternatively, outer wall member 36 may be physically configured or shaped to enhance tactile comfort beyond properties or characteristics imparted to such gripping portions by the nature of the material itself. For instance, the surface of outer wall member 36 may be textured, roughened, or otherwise not smooth to affect the overall tactile sensation imparted by outer wall member 36 and/or to reduce 15 possible slipperiness during the gripping action. In an exemplary embodiment, outer wall member 36, instead of having a smooth surface, may include a slightly elevated or raised pattern thereon. Preferably, the pattern may comprise a plurality of slightly elevated sections 41. Elevated sections 41 can be in any desired shape and arranged in any desired pattern. For instance, elevated sections 41 may be interconnected so as to form a continuous lattice or pattern provided over a portion of or over the entire smooth surface of outer wall member 36 The elevated sections 41, which preferably occupy less surface area than the smooth surface, are resiliently deformable by the user's fingers, so that additional traction between outer wall member 36 and the user's forgers is provided in addition to the friction between outer wall member 36 and the user's fingers. Moreover, elevated sections 41 may be formed of unconnected shapes which may nevertheless be disposed continuously over the smooth surface of wall member 36. Elevated sections 41 provide a soft, textured surface which is resiliently deformable and is therefore not prone to slippage between the user's thumb and fingers.

Inner wall member 38 can either be flexible or rigid. It will be appreciated that inner wall member 38 can be generally configured to facilitate the mounting of cushioning element 20 on article 90. Exemplarily, but not restrictively, inner wall member 38 can be shaped according to the configuration of article 90 on which cushioning element 20 is to be mounted. If desired, the diameter of the interior space within inner wall member 38 may be slightly smaller than the outer diameter of the article over which cushioning element 20 is to be mounted so that cushioning element 20 fits snugly and securely over the article. In an embodiment where article 90 is tapered, inner wall member 38 can also be tapered so that cushioning element 20 may be easily sleeved and secured onto article 90. Alternatively, inner wall member 38 may be tapered with respect to article 90 to secure cushioning element 20 thereon. Additionally or alternatively, inner wall member 38 may be formed from a material capable of conforming to the configuration of article 90 on which cushioning element 20 is to be mounted.

In an exemplary embodiment, inner wall member 38 can be so configured and constructed so that it may serve as at least a portion mounting member 70 for mounting cushioning element 20 onto article 90. For instance, at least a portion of inner wall member 38 may include a mounting surface 72. It will nevertheless be appreciated that mounting member 70 can be separately formed and then provided on cushioning element 20 in a conventional manner, such as adhesion.

Mounting surface 72 can be either flexible or rigid. If desired, mounting surface 72 may be textured, such as by the provision of a plurality of rib members (not shown), to enhance the friction between mounting surface 72 and a corresponding surface on article 90 to secure cushioning element 20 on article 90. It will be appreciated that mounting surface 72 may be otherwise formed, such as with a layer of adhesive material, to assist in fixing cushioning element 20 on article 90.

Turning now to the formation and assembly of encasing member 30, wall members 36 and 38 may be formed by various conventional processes. For instance, wall members 36 and 38 can be made of compatible materials. Accordingly, wall members 36 and 38 can be integrally formed as a unitary member (as described above), such as through a molding process. Exemplary materials for wall members 36 and 38 include, but are not limited to, rigid materials such as metal, wood, and the like and/or flexible materials such as synthetic or natural rubber, thermoplastic elastomers, thermoplastic resins, polyester, elastomer or plastic reinforced textiles (woven or non-woven), polyurethane, nylon, textiles of all sorts, leather, or the like. Alternatively or additionally, wall members 36 and 38 can be made of the same material as that of deformable portion 32 and integrally formed therewith as a unitary member. In the exemplary embodiment of FIGS. 1 and 2, wall members 36 and 38 are continuously formed at respective end portions 37 and 39 (i.e., are continuous at end portions 37, 39), leaving an opening 35 between opposite end portions 42 and 44. As a result, filling chamber 50 may be formed between wall members 36 and 38 and sealed end portions 37 and 39. Particulate matter 60 may be filled into filling chamber 50 via opening 35. Once filling chamber 50 is sufficiently filled, opening 35 may be closed in any desired manner to prevent particulate matter 60 from leaking out. For instance, an end plug 40 may be secured to outer and inner wall members 36 and 38 by various processes, such as those used to join wall members 36 and 38 together, to close opening 35.

Alternatively, wall members 36 and 38 may be directly coupled together in any desired manner, such as any of the joining, coupling, sealing, or securing methods described herein. Depending on the type of particulate matter 60 used, it may be desirable to form filling chamber 50 as a scaled chamber by sealing together all elements thereof, including end plug 40. Alternatively, if adjustability is desired, opening 35 may be closed in a manner which prevents leakage of particulate matter 60 from filling chamber 50 yet which permits reopening as desired in order to alter the type or quantity or other characteristic of particulate matter 60 within filling chamber 50. For instance, end plug 40 or any other closure element may be removably coupled to encasing member 30 to permit selective access to filling chamber 50 to permit changing of particulate matter 60 (e.g., changing of quantity, type, etc.).

In another. exemplary embodiment, encasing member 30 can be formed through a conventional molding process. Accordingly, encasing member 30, including outer and inner wall members 36, 38 and deformable portion 32 can be unitarily constructed. It will be appreciated that an opening 35 may be provided on encasing member 30 for filling particulate matter 60 into filling chamber 50 as discussed above. In addition to forming encasing member 30 in a desired shape, such a molding process can be advantageous in various other aspects. For instance, the molding process can conveniently be used to form a desired textured pattern on outer wall member 36 as discussed above. Additionally or alternatively, a molding process is effective in simultaneously forming a desired number and shape of rib members 52 and/or partition members 54 as discussed in great detail below.

If desired, encasing member 30 may be formed with rib members 52 that can extend from the interior of encasing member 30 into filling chamber 50 to affect the flow of particulate matter 60 therein and thereby to influence the cushioning effect. Such rib members 52 can be conveniently formed along with the rest of encasing member 30 through a conventional molding process. When a molding process is used to form rib members 52, the number, orientation, and location of the rib members 52 may be easily altered to achieve various effects. For instance, rib members 52 may extend longitudinally, spirally, or transversely, and may extend from either or both outer and inner wall members 36 and 38. In the exemplary embodiment of FIG. 3, a plurality of longitudinal rib members 52 extend from inner wall member 38 into filling chamber 50. It will be appreciated that other embodiments of rib members 52 for similar functions are also within the scope of the present invention.

Figure 4:
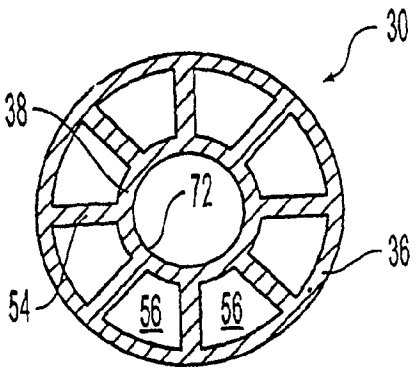
FIG. 4 is an alternate transverse cross-sectional view of the encasing member of FIG. 2, taken from a position away from both end portions of the encasing member.

In an alternate embodiment, partition members 54 may be provided to extend completely across one wall member 36 or 38 to the other wall member 38 or 36 and to divide filling chamber 50 into a plurality of separate compartments 56, as shown in FIG. 4. In addition to assisting in controlling the flow of particulate matter 60, such as achieved by rib members 52 discussed above, compartments 56 may also allow a user to fill different types of particulate matter 60 in different compartments 56. Thereby, an encasing member 3 with multiple compartments 56 can provide varying cushioning effects at any portion and/or along the circumferential and/or longitudinal extent of encasing member 30.

Figure 3:
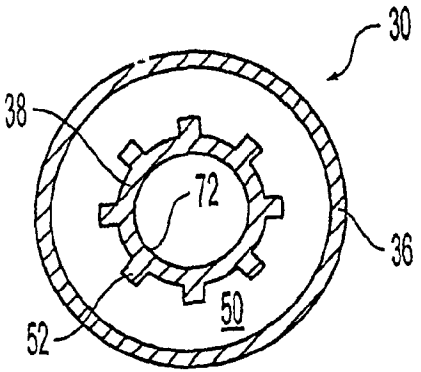
FIG. 3 is a transverse cross-sectional view of the encasing member of FIG. 2, taken from a position away from both end portions of the encasing member.

Similar to rib members 32 of FIG. 3, partition members 54 of FIG. 4 may be conveniently formed together with encasing member 30 through a conventional molding process. As discussed above, when a molding process is used to form partition members 54, the number, orientation, and cross-sectional shape thereof may be easily altered as desired. Accordingly, partition member 54 can be formed in any desired orientation, such as in a longitudinal, spiral, or transverse orientation with respect to longitudinal axis 51 of filling chamber 50. In one embodiment, compartments 56 can be configured to have a honeycomb cross-sectional shape (not shown). In the exemplary embodiment of FIG. 4, a plurality of partition members 54 extend longitudinally to divide filling chamber 50 into multiple longitudinally extending compartments 56. It will be appreciated that other embodiments of partition members 54 for similar functions are also within the scope of the present invention.

It will be appreciated that encasing member 30 can be otherwise formed. For instance, wall members 36 and 38 may be separately formed and later joined together (also as described above) through conventional processes such as ultrasonic, kinetic, or other form of welding, heat sealing, adhesion (e.g., through application of adhesives), mechanical couplings (e.g., fasteners or sealing rings), or the like. Such joining processes may also be applied in sealing portions of a unitary member forming both wall members 36 and 38, or any other portions of encasing member 30. Various other methods for forming encasing member 30 are also within the scope of the present invention.

It will be appreciated that cushioning element 20 as shown in FIGS. 1 to 4 can be configured as an independent, self-standing element. Accordingly, such cushioning element 20 can be manufactured independently and separately from article 90, which can be any article such as a conventional hand-held article as mentioned above. Once filled with particulate matter 60, cushioning element 20 can be selectively mounted on article 90 to provide a cushioning effect therefor. It will be appreciated that cushioning elements 20 formed according to this embodiment can be removably and interchangeably mounted on a variety of different articles.

Figure 5:
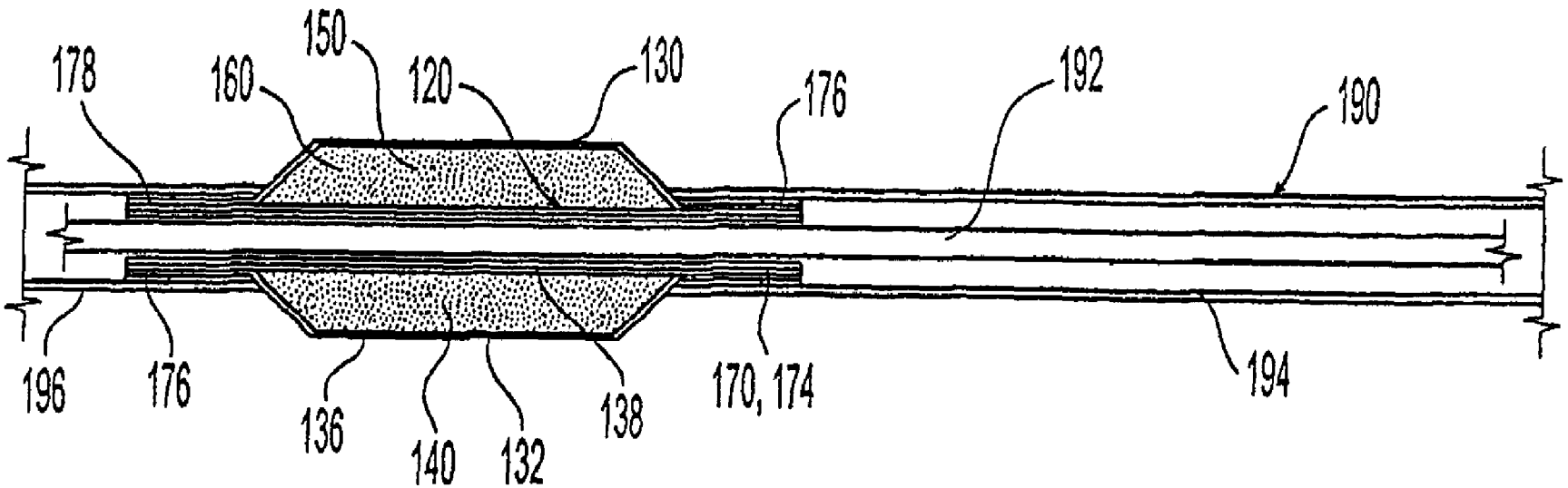
FIG. 5 is a longitudinal cross-sectional view of a cushioning article in accordance with the principles of the present invention.

FIG. 5 illustrates an alternate embodiment of a cushioning element formed in accordance with the principles of the present invention. In the following description, elements or components similar to those in the embodiment of FIGS. 1 to 4, are designated with the same reference numbers increased by 100 and redundant description is omitted. In this embodiment, cushioning element 120 may be constructed as a structural portion of article 190 on which cushioning element 120 is to be provided and thus at least a portion of cushioning element 120 may constitute an integral portion of article 190. More particularly, at least a portion of cushioning element 120 may be formed to substitute for a structural portion of article 190. It will be appreciated that any portion of cushioning element 120 may serve the dual function of a portion of cushioning element 120 and a structural portion of article 190. Moreover, various configurations of cushioning element 120 and a corresponding article 190 are within the scope of the present invention, the invention not being limited by the exemplary embodiment of FIG. 5. It will be appreciated that cushioning element 120 may be removably coupled with a portion of article 190 through the use of interchangeable fasteners, such as screws or snap connectors. Accordingly, cushioning element 120 may be interchangeable with another cushioning element or with the portion of article 190 substituted for cushioning element 120.

In the embodiment of FIG. 5, inner wall member 138 of encasing member 130 may be formed to replace a structural portion of article 190. If desired, inner wall member 138 may have some or all of the characteristics of the structural portion of article 190 which inner wall member 138 is to replace. For instance, inner wall member 138 may be rigid and tubular to substitute for a rigid tubular structure of an article 190. For instance, article 190 of FIG. 5 may be in the form of a writing instrument, such as a conventional pen, and inner wall member 138 may be constructed as a portion of the barrel of the writing instrument. A writing medium reservoir 192 may then extend through inner wall member 138. Other barrel portions, such as rear and front barrel portions, may be coupled to cushioning element 120, as described in greater details below, further incorporating inner wall member 138 into the structure of article 190.

To facilitate incorporation of cushioning element 120 into article 190, a mounting member 170 can be provided on at least a portion of cushioning element 120, such as on encasing member 130 thereof. In the embodiment of FIG. 5, mounting member 170 may include at least one end member 174 extending from rigid inner wall member 138 for coupling with body portion 194 of article 190. End member 174 is adapted to be either inserted in or placed over body portion 194 of article 190 and to be coupled thereto through various fastener means, such as end sealing rings 176, or screws or snap connectors.

FIG. 5 further illustrates the construction of a cushioning article according to the principles of the present invention. In forming such a cushioning article, cushioning element 120 can be formed pursuant to any one of the above exemplary embodiments. In an exemplary embodiment, filling chamber 150 of cushioning element 120 can be at least partially filled with particulate matter 160. In a preferred embodiment, filling chamber 150 can be substantially fully filed with particulate matter 160. Moreover, mounting member 170 formed on cushioning element 120 can be coupled to article 190 to thus join cushioning element 120 with article 190. It will be appreciated that cushioning element 120 can be coupled to article 190 either before or after filling particulate matter 160 in filling chamber 150. In an exemplary embodiment, mounting member 170 can couple cushioning element 120 to a hand-held article 190 to provide a comfortable grip thereto. In an alternative embodiment, mounting member 170 can couple cushioning element 120 to a sports equipment 190 to provide a shock absorption effect thereto. In a further embodiment, mounting member 170 can couple cushioning element 120 to an article 190 to provide both comfortable contact and shock absorption.

Other structural portions of article 190 may be mounted on other sections of cushioning element 120. Exemplarily, but not restrictively, rigid inner wall member 138 can be constructed to include an additional end member 178 also forming a mounting member 170. End member 178 can be adapted for coupling with another structural body portion 196 of article 190. In an embodiment where article 190 is in the form of a writing instrument, body portions 194 and 196 can be rear and front barrels of writing instrument 190 and can be coupled to end members 174 and 178 on inner wall member 138. Writing medium reservoir 192 can thus extend through inner wall member 138 of cushioning element 120, and rear and front barrels 194 and 196 of writing instrument 190. This configuration of cushioning element 120 can be particularly advantageous for use with refillable writing instruments.

Figure 6:
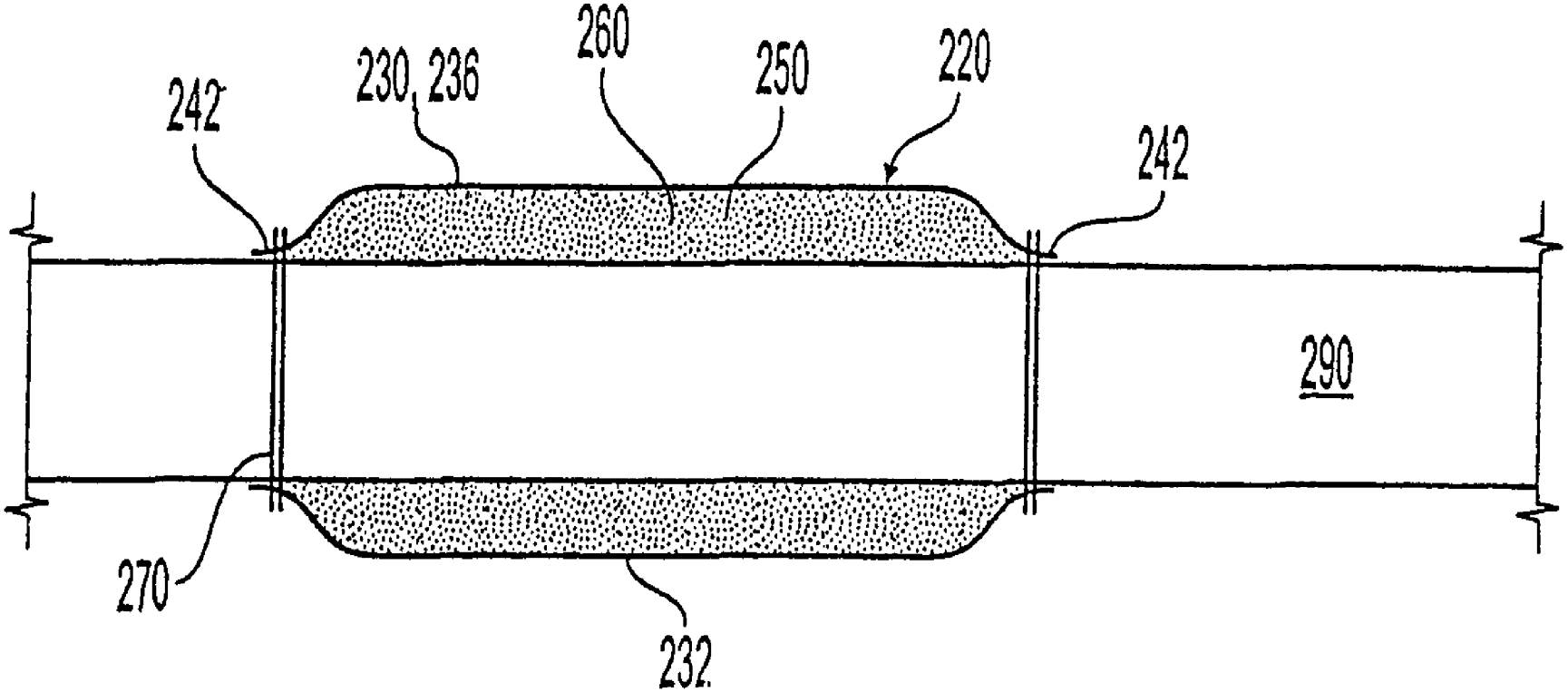
FIG. 6 is a longitudinal cross-sectional view of an alternate cushioning article in accordance with the principles of the present invention.

FIG. 6 illustrates another embodiment of a cushioning element formed in accordance with the principles of the present invention. In the following description, elements or components similar to those in the embodiment of FIGS. 1 to 4, are designated with the same reference numbers increased by 200 and redundant description is omitted. In contrast to self-contained cushioning elements 20 and 126 as described above, a portion of cushioning element 220 is formed from a portion of the article 290 on which cushioning element 220 is to be provided. As a result, article 290 can contribute to the formation of at least a portion of cushioning element 220 and cushioning element 220 would be incomplete without article 290.

In an exemplary embodiment, encasing member 230 can be a sheath or wall member 236 placed over a portion of article 290 on which cushioning element 220 is to be provided. According to this embodiment, filling chamber 250 is defined between wall member 236 of encasing member 230 of cushioning element 220 and a portion of article 290, rather than within a self-contained portion of cushioning element 220. It will be appreciated that at least a portion of wall member 236 may include deformable portion 232, as described above. Wall member 236 may include free end portions 242 that is adapted to be coupled to article 290 through mounting member 270. Mounting member 270 may include various conventional mechanisms capable of mounting free end portion 242 on article 290. Such mechanisms may include, without limitation, ultrasonic, kinetic, or other forms of welding, heat sealing, adhesion (e.g., through application of adhesives), mechanical couplings (e.g., fasteners, pressure rings, or sealing rings), or the like.

In an embodiment where article 290 is elongated, wall member 236 may be tubular and may be placed to surround the grip portion of article 290. Tubular wall member 236 may have free end portions 242 that can be coupled to article 290 through mounting member 270 as described above. Consequently, an enclosed filling chamber 250 may be formed between tubular wall member 236 and a portion of article 290 and between end portions 242.

Cushioning element 220 can be formed during the manufacture of article 290. In an exemplary embodiment, cushioning element 200 can be partially mounted onto article 290, such as through one free end portion 242, to partially form filling chamber 250. It will be appreciated that an opening is provided through which particulate matter 260 may be filled into filling chamber 250. After particulate matter 260 sufficiently fills filling chamber 250, the opening can be closed to thus close filling chamber 250. At the same time, cushioning element 220 may be mounted on article 290 to form an integral assembly therewith. However, it will be appreciated that various alternate methods for constructing cushioning element 220 are also within the scope of the present invention.

FIGS. 7 to 10 depict a further embodiment of a cushioning element formed in accordance with the principles of the present invention. In the following description, elements or components similar to those in the embodiment of FIGS. 1 to 4, are designated with the same reference numbers increased by 300 and redundant description is omitted. In this embodiment, cushioning element 320 may be constructed so that its initial shape can be altered by a user before the user grips cushioning element 320 to modify the density or flowability of particulate matter 360.

In an exemplary embodiment, cushioning element 320 may be similarly formed as that of FIGS. 1–4 except that at least one of its free end portions 342 is movably mounted onto article 390. Optionally, one of the free end portions 342 maybe mounted to an end plug 340 similar to that of FIG. 1. End plug 340, in turn, can be adapted to move along article 390 between a compact position and a telescoped position and seal filling chamber 350 at the same time. The free end portions 342 are the closest to each other in the compact position and the farthest from each other in the telescoped position.

Figure 7:
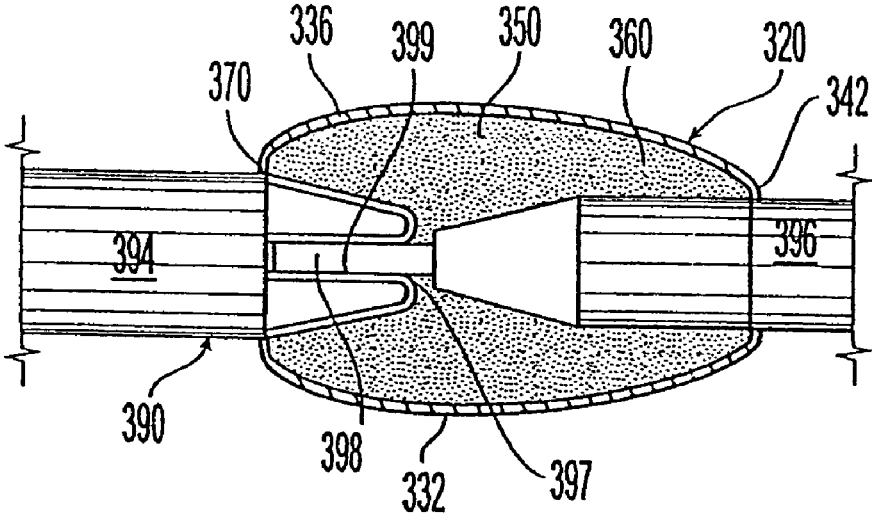
FIG. 7 is a longitudinal cross-sectional view of another alternate cushioning article in accordance with the principles of the present invention, in which cushioning article is in a retracted position.
Figure 8:
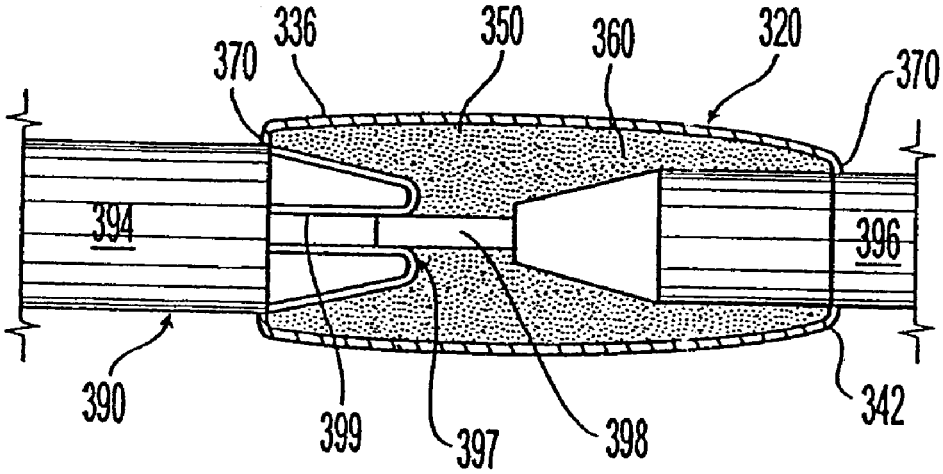
FIG. 8 is a longitudinal cross-sectional view of the cushioning article of FIG. 7, in which cushioning article is in an extended position.
Figure 9:
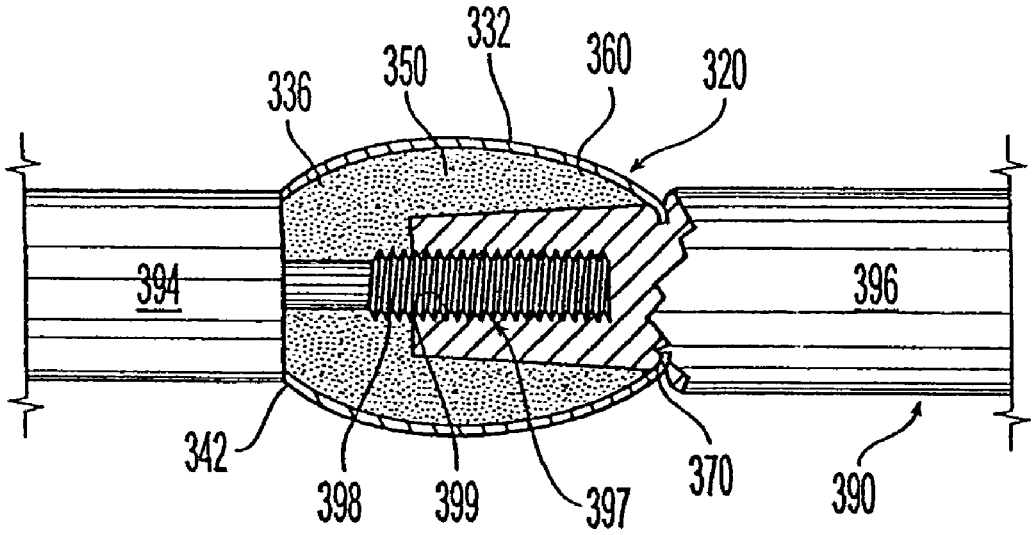
FIG. 9 is a longitudinal cross-sectional view of a further cushioning article in accordance with the principles of the present invention, in which cushioning article is in a retracted position.
Figure 10:
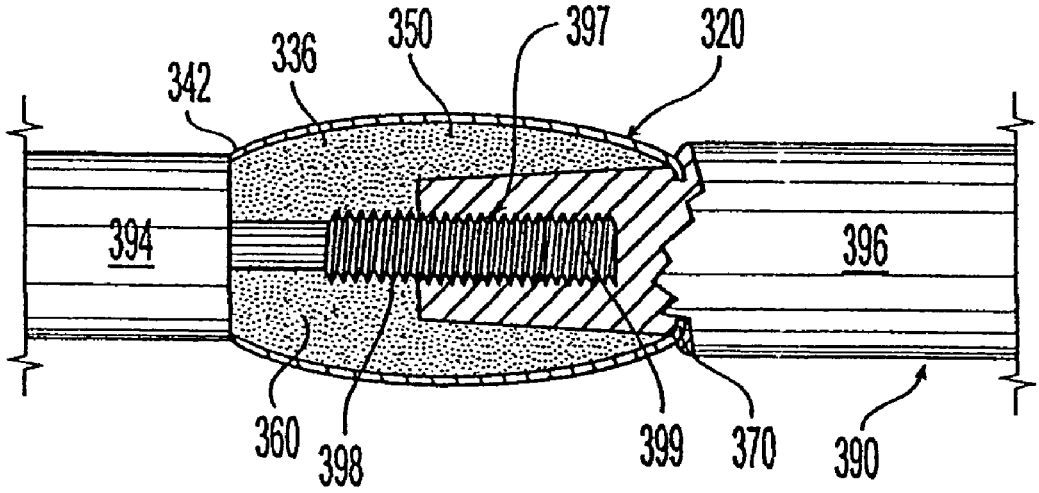
FIG. 10 is a longitudinal cross-sectional view of the cushioning article of FIG. 9, in which cushioning article is in an extended position.

In another exemplary embodiment, cushioning element 320 may be similarly formed as that of FIG. 6 and adapted to be mounted onto article 390. Alternatively or additionally, article 390 can include an adjustable joint 397 movably joining body portions 394 and 396. Optionally, adjustable joint 397 can be formed of a pair of complementary joining elements 398 and 399 that can move toward or away from each other between a compact position and a telescoped position. In an exemplary embodiment as shown in FIGS. 7 and 8, joining elements 398 and 399 can be complementary pin and socket members. In an alternative embodiment as shown in FIGS. 9 and 10, joining elements 398 and 399 can be complementary screw members. It will be appreciated that various alternate embodiments of adjustable joints 397 are within the scope of the present invention.

When the free end portions 342 or the joining elements 398 and 399 are moved toward the compact position, outer wall member 336 can be forced into a bulged shape. As a result, the transverse dimension of cushioning element 320 increases. Accordingly, when the bulged cushioning element 320 is subjected to a transverse deforming force, cushioning element 320 can have a larger yielding room to counteract such deforming force and thus provide an increased cushioning effect.

Additionally or alternatively, when cushioning element 320 moves between the compact position and the telescoped position, the contour of and, as a result, the stretching degree of deformable portion 332 can change accordingly. Because cushioning effect is a combination of factors including the stretching degree of deformable portion 332 as described hereinabove, the cushioning effect can be varied by altering cushioning element 320 between a compact position and a telescoped position.

Further, the change in the transverse dimension of cushioning element 320 can alter the grip size of a hand-held article 390. Accordingly, cushioning element 320 formed according to this embodiment can provide variable grip for different users.

Similar to that of FIG. 6, cushioning element 320 may be formed during the manufacture of article 390. It is preferred that complementary joining elements 398 and 399 can be at least partially joined to each other before mounting cushioning element 320 onto article 390. Cushioning element 320 can be mounted onto article 390 similarly to that 35 described above.

Figure 11:
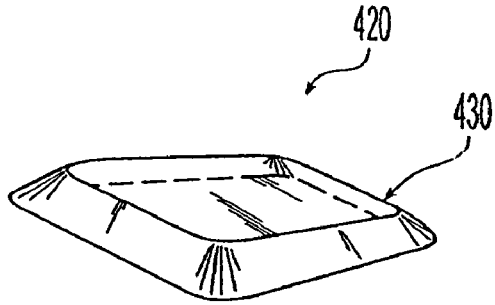
FIG. 11 is a perspective view of a cushioning element in the form of a pad in accordance with the principles of the present invention.
Figure 12:
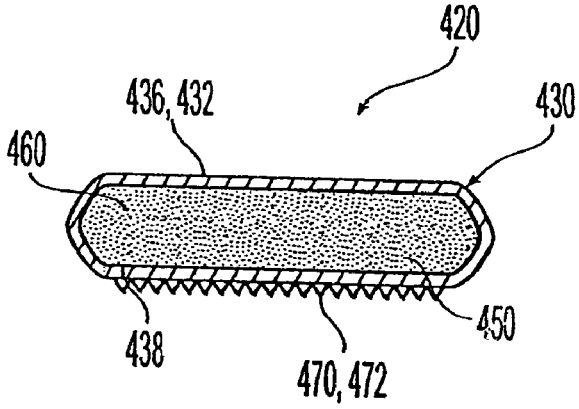
FIG. 12 is a cross-sectional view of the cushioning clement of FIG. 11, taken from a position away from both end portions of the encasing member.
Figure 13:
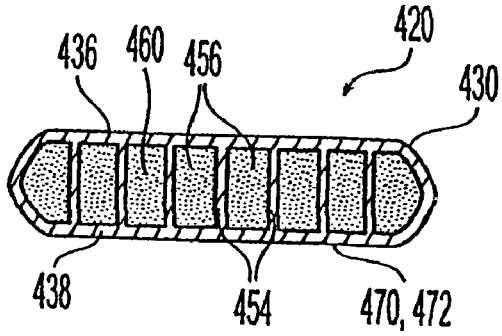
FIG. 13 is an alternate cross-sectional view of the cushioning element of FIG. 11, taken from a position away from both end portions of the encasing member.

FIGS. 11 to 13 illustrate a further embodiment of cushioning element 420 formed according to the general principles of the present invention. In the following description, elements or components similar to those in the embodiment of FIGS. 1 to 5 are designated with the same reference numbers increased by 400 and redundant description is omitted. Cushioning element 420 can be used to provide comfortable cushioning for articles contacting a user (e.g., splints, casts, seats, pillows, mattresses, and the like), or to substitute for other forms of padding on articles (e.g., clothing articles with padding, such as brassieres, or eyeglass nose pads). Additionally or alternatively, cushioning element 420 can be used to provide shock absorption for impact articles 490, such as various sports equipments (e.g., helmets and body protecting pads).

More particularly, the following illustrative, non-limiting embodiments of the present invention provide improved cushioning while being capable of being compressed by a user without exerting additional pressure to maintain the fitting shape. For example, the present invention is operable to be employed as: a goggle flange, a hardhat liner, a headgear pad, an ear and/or nose pad, earmuff cups, an earmuff band liner, or ear plugs. Further, the present invention is operable to be employed as: padding on a fall protection harness, padding on SCBA harness, shoe liners, cooling/heating vests and collars, anti-vibration gloves, cooling gloves, knee pads, standing mats, non-skid treads, pillow suits, and cooling caps/ on hard hats. Moreover, the present invention can be employed in a human cast system, an animal cast system, a prosthetic socket liner device, a rigid brace and a reticulated brace, fishing rod handles for fly rods and spinning rods, form fitting shoes, power tool grips, hand tool grips, golf club grips, tennis and other racquet sports handle grips. Additionally, the present invention can be employed to form foot gripping pads for articles, such as a wind surfer, skate board, or surf board. Other exemplary embodiments of the present invention include: baseball glove padding, knee, shin, and elbow protectors, driving gloves, work gloves, neck protective and cooling braces, ski boots, work boots, snowboarding boots, vehicle seats (both recreational and construction), automobile seats, visors, and other articles that benefit from impact protection, such as bicycle seats, motorcycle seats, bicycle handlebars, hand grips and safety grips, and automobile steering wheel surfaces. Still other exemplary embodiments of the present invention include: cushioning elements for providing shock absorption, cushioning elements for providing a barrier, enclosed pistons, knife handles, rifle stocks and/or recoil pads, grips, furniture seats, task seating, bra padding and cooling, padded computer peripheral devices, such as a computer mouse, mouse pads, padded sports clothing, such as biking or rowing clothing, etc., sports cooling neck wraps or pads, head bands, and wrist bands, among other things.

In the above mentioned embodiments, encasing member 430 may be formed with one or more wall members 436, 438 which may define an internal filling chamber 450 therebetween for containing particulate matter 460. At least one wall member 436 or a portion of a single-walled encasing member 430 is in a user-contacting position (or secondary article contacting position, respectively) and may include a deformable portion 432. The other wall member 438 or a portion of a single-walled encasing member 430 is provided with a mounting member 470 for mounting cushioning element 420 onto a portion of article 490. Thus, it will be appreciated that encasing member 430 is formed as a pad configured for mounting cushioning element 420 on an article such that cushioning element 420 is mounted on a portion of an article without surrounding or enveloping the article.

Mounting member 470, which facilitates mounting of cushioning element 420 on an article 490, may include a mounting surface 472 which is partially formed with the article-contacting side of encasing member 430. For instance, mounting surface 472 may partially be integrated with wall member 438 and may be constructed to conform to a portion of article 490 on which cushioning element 420 is to be provided. Additionally or alternatively, mounting member 470 may include fasteners to secure cushioning element 420 on article 490. Exemplary mounting members 470 may include, without limitation, hook and loop material (e.g., VELCRO® material), snaps, or fastening straps. It will be appreciated that various alternate embodiments of mounting member 470 are within the scope of the present invention.

As shown in FIG. 13, filling chamber 450 can be partitioned by partition members 454 into several compartments 456 to control and limit the flow of particulate matter 460 within filling chamber 450. In addition, different types of particulate matters 460 may be filled into the various compartments 454 so as to provide varying cushioning effects in different regions of encasing member 430. Ribs, such as provided in the embodiment of FIG. 3, may be provided instead. The configurations and orientations of the partition members or ribs may be varied as desired, such as described with respect to the partition members or rib members of FIG. 3 or 4.

It will be appreciated that the various features described herein may be used singly or in any combination thereof. Therefore, the present invention is not limited to only the embodiments specifically described herein. While the foregoing description and drawings represent a preferred embodiment of the present invention, it will be understood that various additions, modifications, and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiment is therefore to be considered in all respects as illustrative and not restrictive, the scope of the invention being indicated by the appended claims, and not limited to the foregoing description.

What is claimed is:

1. A cushioning element operable to contact a secondary object for cushioning, said cushioning element comprising:

a bladder body having inner and outer walls sealingly closed at opposite ends of the bladder body, or one end selectively, and defining at least one chamber between the inner and outer walls, particulate material comprising micro-spheres in air filling the at least one chamber, the outer wall being flexible and capable of being deformed into a deformed shape as particulate material in the at least one chamber is moved by a pressing operation which is applied to the outer wall, and the inner wall being operable to receive a mounting member for mounting the bladder body to an article;

wherein the particulate material in the at least one chamber that is moved by the pressing operation remains in the same position upon completion of the pressing operation for eliminating back-pressure exerted by the particulate material against the flexible outer wall, thereby maintaining the flexible outer wall in substantially the deformed shape which the flexible outer wall assumed during the pressing operation, and the particulate material in air and the sealingly closed opposite ends of the bladder body cooperating to resist leakage of the at least one chamber and configuring the particulate material within a specific space allowing the particulate material to pack and hold the deformed shape assumed during the pressing operation.

2. The cushioning element as claimed in claim 1, wherein the at least one chamber comprises a single molded part or a multi-chambered enclosure, and wherein the at least one chamber is disposed in a linear, sequential, or random manner.

3. The cushioning element as claimed in claim 1, wherein the secondary object is a part of a human body.

4. The cushioning element as claimed in claim 1, further comprising a mounting member, wherein said mounting member comprises a mounting surface integrated with at least a portion of said inner wall, said mounting surface being contoured to at least partially correspond to a shape of the secondary object.

5. The cushioning element as claimed in claim 1, further comprising a mounting member, wherein said mounting member is provided on said inner wall.

6. The cushioning element as claimed in claim 1, wherein an opening is provided between said outer wall and the inner wall, said opening for allowing particulate matter to be filled into said at least one chamber; and wherein a closure element is provided in said opening to close said at least one chamber.

7. The cushioning element as claimed in claim 6, wherein said closure element is coupled removably to said inner wall to permit selective access to said at least one chamber.

8. The cushioning element as claimed in claim 6, wherein said closure element is sealed to said inner wall to seal said opening.

9. The cushioning element as claimed in claim 1, wherein said outer wall is made of a material selected from a group consisting of synthetic and natural rubber, thermoplastic elastomers, thermoplastic resins, polyester, elastomer and plastic reinforced textiles, polyurethane, nylon, textiles, and leather.

10. The cushioning element as claimed in claim 1, wherein said inner wall is rigid; and wherein said inner wall is integral with a portion of the article on which said cushioning element is mounted and forms a structural portion of the article.

11. The cushioning element as claimed in claim 1, further comprising a mounting member, wherein said mounting member has a mounting surface operable to be coupled to the article.

12. The cushioning element as claimed in claim 1, wherein said particulate matter substantially fills the entire volume of said at least one chamber.

13. The cushioning element as claimed in claim 1, wherein said particulate matter comprises individual particles sized and dimensioned to be capable of freely flowing within said at least one chamber to allow said cushioning element to deform.

14. The cushioning element as claimed in claim 1, wherein said particulate matter is made of a material selected from the group consisting of thermoplastics, thermoset plastics, synthetic and natural rubber, quartz, mineral, ceramics, silicon, glass, metals, phenol, wood, silica, sand, salt, seeds, grain, organic materials, microbeads, microspheres, granules, crystallized and powder particles.

15. The cushioning element as claimed in claim 1, wherein the inner wall is rigid.

16. The cushioning element as claimed in claim 1, wherein partitions or ribs extend from the inner wall toward the outer wall.

17. The cushioning element as claimed in claim 1, wherein spoke-shaped walls or partitions extend between the inner wall and the outer wall.

18. The cushioning element as claimed in claim 1, wherein a first end of the cushioning element is molded closed and a second end of the cushioning element is sealingly closed.

19. A cushioning element operable to contact a secondary object for cushioning, said cushioning element comprising:

a bladder body having inner and outer walls sealingly closed at opposite ends of the bladder body, or one end selectively, and defining at least one chamber between the inner and outer walls, particulate material comprising micro-spheres in air filling each of the chambers, the outer wall being flexible and capable of being deformed into a deformed shape as particulate material in the chambers is moved by a deforming force applied to the outer wall by the secondary object, the deformed shape corresponding to a shape of the secondary object, and the inner wall being operable to receive a mounting member for mounting the bladder body to an article;

wherein the particulate material in the chambers that is moved by the deforming force remains in the same position upon completion of the deforming force for eliminating back-pressure exerted by the particulate material against the flexible outer wall, thereby maintaining the flexible outer wall in substantially the deformed shape which corresponds to the shape of the secondary object which the flexible outer wall assumed during the application of the deforming force, and the particulate material in air and the sealingly closed opposite ends of the bladder body cooperating to resist leakage of the chambers and configuring the particulate material within a specific space allowing the particulate material to pack and hold the deformed shape assumed during the application of the deforming force.

20. The cushioning element as claimed in claim 1 wherein the amount of air in at least one chamber affects properties of the said chamber, including at least one of insulation, compressibility and cushioning effect.

* * * * *